United States Patent [19]

Wall

[11] 4,208,021

[45] Jun. 17, 1980

[54] FENCING WIRE DISPENSER

[76] Inventor: John R. Wall, R.F.D. #5, Box 122, Waynesburg, Pa. 15370

[21] Appl. No.: 947,434

[22] Filed: Oct. 2, 1978

[51] Int. Cl.[2] ..... B65H 17/46; B65H 75/30

[52] U.S. Cl. ..... 242/86.5 R; 242/129; 254/64

[58] Field of Search ..... 242/86.5 R, 86.7, 99, 242/129, 129.1, 129.8; 254/64

[56] References Cited

U.S. PATENT DOCUMENTS

| | | | |
|---|---|---|---|
| 809,721 | 1/1906 | Myers | 254/64 |
| 2,789,778 | 4/1957 | Zogg | 242/86.7 |
| 2,914,270 | 11/1959 | Parker | 242/86.5 R |
| 3,048,348 | 8/1962 | Griffin | 242/86.5 R |
| 3,902,679 | 9/1975 | Bost | 242/129 |

*Primary Examiner*—Edward J. McCarthy
*Attorney, Agent, or Firm*—Robert D. Yeager

[57] ABSTRACT

Mobile apparatus for simultaneously dispensing multiple strands of fencing wire. The apparatus includes a plurality of stacked, individually rotatable spools each of which carries a coil of fencing wire. The apparatus is provided with skids for towing it along the ground.

6 Claims, 5 Drawing Figures

FENCING WIRE DISPENSER

BACKGROUND OF THE INVENTION

1. Field of the Invention

This invention relates to apparatus for dispensing wire; more particularly, to a mobile apparatus for simultaneously dispensing multiple strands of fencing wire.

2. Description of the Prior Art

The installation of farm fencing, especially fencing of the type used to control livestock, heretofore has involved the expenditure of large amounts of time and labor. These expenditures have been necessitated by the fact that farm fencing requires the installation of multiple strands of wire, sometimes as many as twelve, in order to adquately control farm livestock and/or prevent the ingress of animal intruders to the fenced area. Typically, such fences have been installed by traversing the proposed fence line with a single reel of steel wire, securing the dispensed wire strand to the end and middle fence posts in the line, stretching the wire strand to the desired degree of tautness, securing the wire strand to the remaining posts in the fence line, and repeating the process with the next strand of wire.

The smooth, high-tensile steel wire commonly used in farm fencing is economically purchased in large reels, e.g. 2000 pound reels. In the installation technique just described, the large reel is conveyed in some manner along the desired fence line, back and forth from one end of the fence line to the other, until the required number of strands have been installed. Because a single fence line many extend to 5000 feet and more, enormous amounts of time and effort are required to complete say a ten-strand fence line of such length.

Wire dispensers have long enjoyed widespread use in industrial applications, particularly in dispensing electrical wire during the wiring of a building. U.S. Pat. Nos. 3,275,263; 2,562,650; 3,722,825; 3,304,025; 3,491,967; 3,178,129; 3,831,877; 3,902,679; and 3,990,653 are illustrative of such apparatus. Some of the devices shown in the foregoing patents are intended to carry and dispense multiple coils of wire; some are intended for mobile use; but none of the devices addresses the problem of simultaneously dispensing multiple strands of wire in spaced relation to one another, a feature that is needed to successfully dispense simultaneously multiple strands of fencing wire.

SUMMARY OF THE INVENTION

The present invention overcomes the shortcomings of the prior art by providing mobile apparatus for simultaneously unreeling a plurality of strands of fencing wire. The wire dispensing apparatus includes a frame, means associated with the frame for facilitating the transport of the frame along the ground, a plurality of coiled wire strands support by the frame, and means disposed within the frame for simultaneously unreeling the wire strands in spaced relation to one another as the frame is so transported.

Preferably the unreeling means of the present invention includes a plurality of rotatable spools having associated wire strand guide means which are vertically spaced from one another, each such spool having one wire strand wound thereon. These spools preferably are supported for rotation on shaft means mounted on the dispenser frame, still further preferably a common vertically mounted shaft, and have wire guide means spaced radially outward therefrom. The wire guide means associated with each spool may be a ring member so that when the spools are in a vertically stacked condition, adjacent ring members will guide the wire strands being unreeled from the spools.

When the spools of the present invention are arranged in a vertical stack; means is provided at the top of the common supporting shaft for retaining the spools in their respective positions. This retaining means preferably includes a bracket pivotally mounted to the dispenser frame, which bracket is arranged to apply a downward force on the stacked spools during operation of the dispenser of the present invention.

Other details and advantages of the present invention will become apparent from a consideration of the following description taken with the accompanying drawings.

DESCRIPTION OF THE PREFERRED EMBODIMENT

Figure 1:
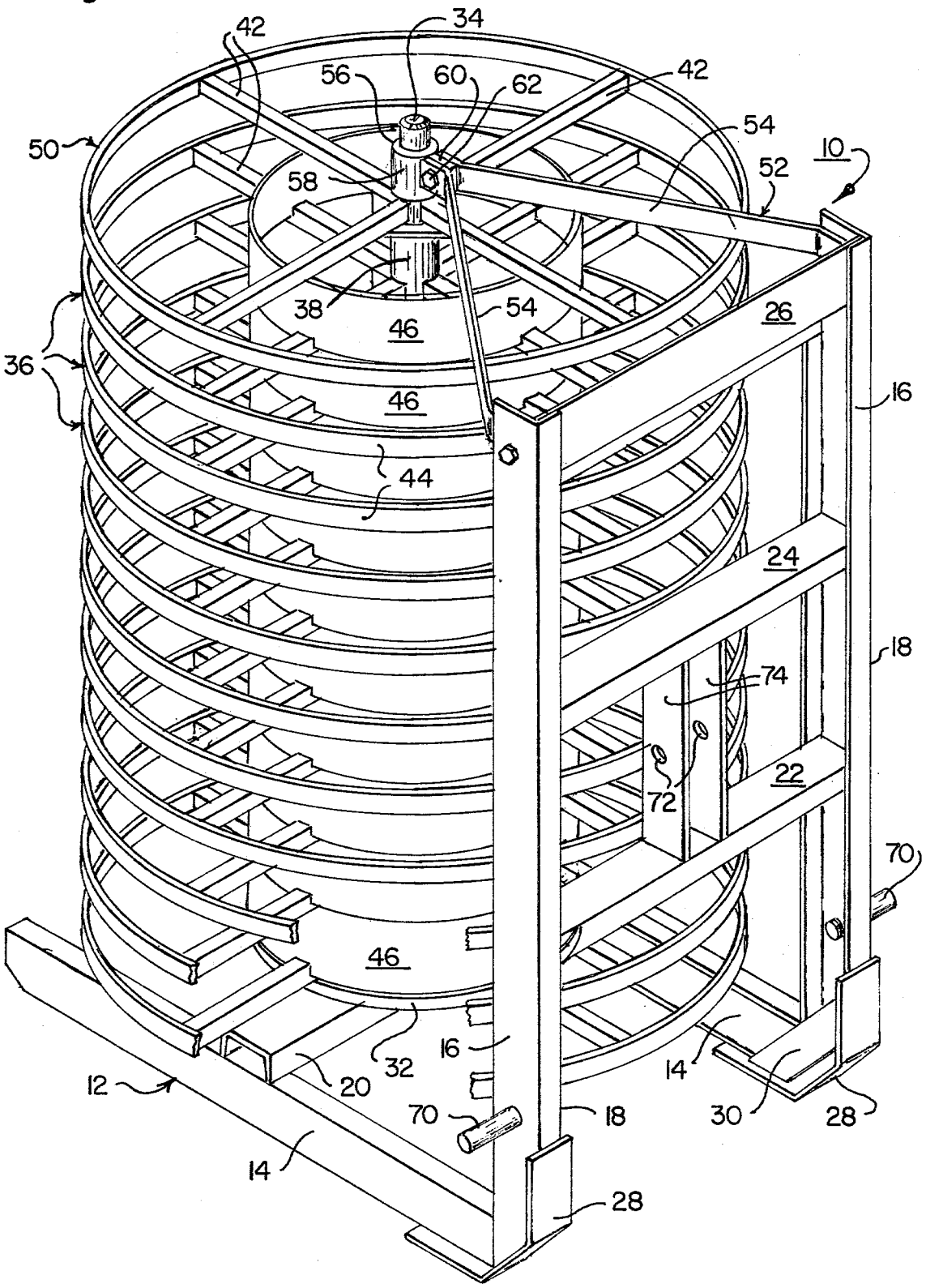
FIG. 1 is a perspective view of the fencing wire dispenser of the present invention.

Referring now to the drawings, particularly to FIGS. 1 through 4, there is shown a mobile fencing wire dispenser 10. Dispenser 10 includes a frame designated by the reference numeral 12. Frame 12 includes a pair of parallel, horizontal base members 14 connected at their forward ends to a pair of upstanding members 16, thus forming a pair of parallel "L" sections generally designated 18. Members 14 and 16 may be formed of heavy gauge channel or box stock. "L" sections 18 are connected by transverse members 20, 22, 24 and 26, which may be formed of channel, plate or other configured stock and which provide structural rigidity for frame 12.

Figure 2:
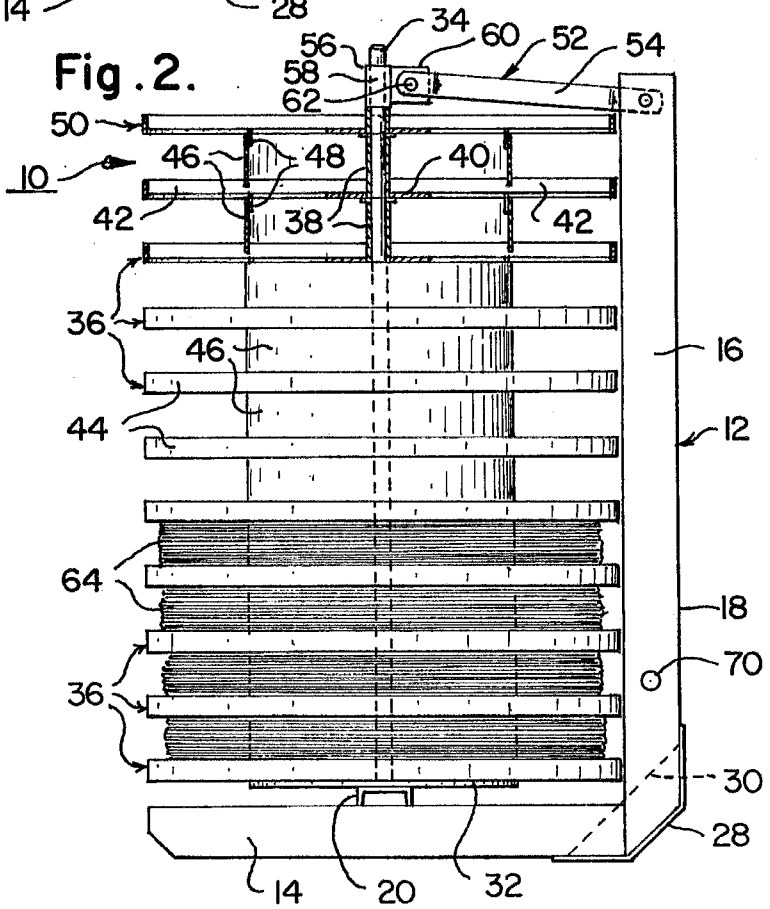
FIG. 2 is a side elevational view, with parts in section, of the dispenser shown in FIG. 1 as seen from the left front thereof.

As best seen in FIG. 2, the bottom ends of upstanding frame members 16 are beveled. Generally U-shaped wear plates 28, which conform to these bevels and to the respective exterior surfaces of upstanding members 16 and horizontal base members 14, are welded to the joints formed by these latter members. Gusset plates 30 reinforce the weldments. Similar beveled surfaces are formed on the rear ends of horizontal base members 14. The purpose of the structure just described is to provide skid means for dispenser 10, with plates 28 being the leading edges of the skids, to facilitate the movement of dispenser 10 along the ground.

Rigidly mounted to the top surface of transverse member 20, intermediate its ends, is disc 32. Disc 32 serves as the base support for a stack of wire spools soon to be described. An upstanding steel shaft 34 is connected to the center of disc 32; shaft 34 is dimensioned to extend slightly above the top of upstanding frame members 16.

Figure 3:
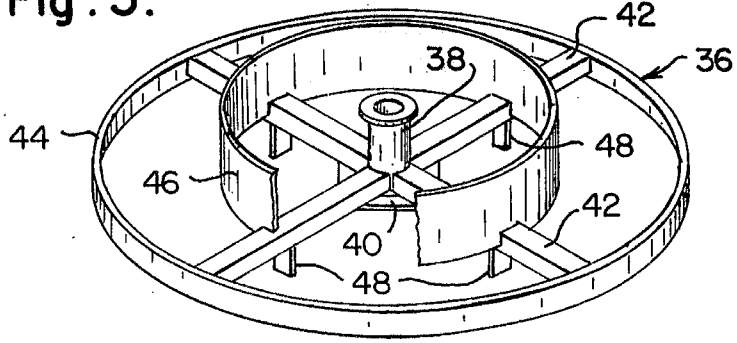
FIG. 3 is a perspective view, with parts broken away, of one of the spools shown in FIGS. 1 and 2.

A plurality of spools generally designated 36 are stacked in co-axial relationship on disc 32 with shaft 34 passing through their centers. In the embodiment shown in the drawings, ten spools are so present but this number may vary as desired. As shown in FIG. 3, spool 36 includes a central hub 38 formed from tubular stock and dimensioned to snugly but rotatably fit on shaft 34. A square wear plate 40, having a central opening of the same diameter as hub 38, is welded to the bottom end of hub 38. Extending radially from hub 38 are four symmetrically arranged support members or spokes 42 of equal length; spokes 42 are shown formed from square tubular stock. The bottom surfaces of spokes 42 are in contact with the top surface of wear plate 40. Attached to the ends of spokes 42 in concentric relationship with hub 38 is an outer ring 44; the lower edge of ring 44 is in the same plane as the bottom surface of wear plate 40. As will be explained hereinafter, outer ring 44 serves as a guide for wire being dispensed from spool 36.

A wire retaining rim 46, having a width substantially equal to the length of hub 38 and greater than the width of outer ring 44, is connected to spokes 42 in concentric relationship with hub 38 and outer ring 44. The bottom edge of rim 46 is notched at its points of connection with spokes 42 so that the bottom edge extends below the top surfaces of spokes 42 and the top edge of rim 46 is is substantially the same plane as the top of hub 38. Extending from the bottom surface of each of spokes 42, at a point slightly inboard of the projected inner surface of rim 46, is a tab 48. The function of these tabs will be discussed hereinafter.

Figure 4:
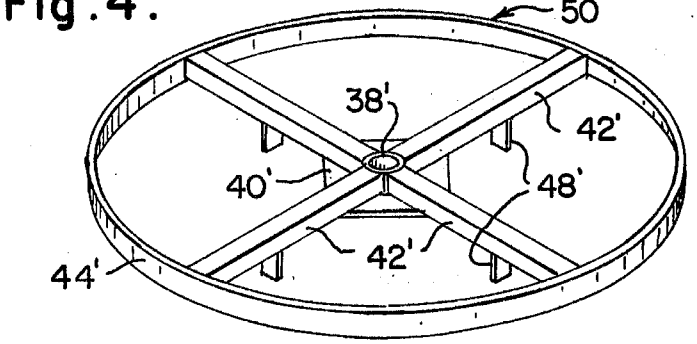
FIG. 4 is a perspective view of the spool retaining ring depicted in FIGS. 1 and 2.

Positioned at the top of the stack of spools 36 is a cap ring 50 (see FIG. 4 in which like-numbered parts to those shown in FIG. 3 bear prime superscripts). The structure of cap ring 50 is identical to that of spool 36 except that hub 38' does not extend above the to surfaces of spokes 42' and cap ring 50 has no wire retaining rim 46. A bracket assembly 52 is arranged between the top of frame 12 and the top of shaft 34; the purpose of bracket assembly 52 is, in cooperation with cap ring 50, to prevent upward movement of the stack of spools 36 while the dispenser 10 is in operation. Bracket assembly 52 and cap ring 50 thus form a spool retaining means.

Bracket assembly 52 includes a pair of arms 54 pivotally mounted at their respective divergent ends to the top ends of upstanding frame members 16 clamping at their respective convergent ends a collar member 56. Collar member 56 consists of a tubular portion 58, dimensioned to snugly fit over the top end of shaft 34, and a flange portion 60 extending radially outwardly to be sandwiched between the convergent ends of arms 54. A pin or bolt 62 extends through aligned holes in the convergent ends of arms 54 and flange portion 60 for adjustably clamping collar member 56. It will be noted in FIG. 2 that bracket assembly 52 extends at a slight upward angle to its engagement with shaft 34. The effect of this arrangement will be discussed below.

The operation of mobile fencing wire dispenser 10 will now be described with reference being made to FIGS. 1 through 5. As alluded to above, dispenser 10 of the present invention permits the simultaneous unreeling and paying out of all strands of wire that will be used in constructing a desired section of fence. Because these strands are unreeled and paid out with vertical separation between adjacent strands, there is little or no tendency for the strands to become fouled even though they may sag to the ground as dispenser 10 traverses a considerable distance before the individual strands are secured to fence posts and drawn taut.

The operation is begun by first paying off fencing wire stored on a larger reel (not shown) and coiling the wire onto the individual spools 36. The number of spools 36 loaded with wire in this fashion depends on the desired number of wire strands in the fence to be constructed; in the embodiment shown in the drawings, a ten wire fence is being constructed. Such a fence has been shown to be effective especially in controlling farm animals, while preventing the ingress of deer and other intruding animals to the fenced enclosure.

Spools 36, each containing a continuous coil of fencing wire, are stacked one on top of the other by threading hubs 38 onto shaft 34. It should be noted that the first spool 36 so threaded onto shaft 34 has no tabs 48; because the lowermost such spool in the stack rests directly on disc 32, the presence of tabs 48 would interfere with the rotational movement of the bottom spool 36 about shaft 34. As each of the remaining nine spools are lowered into position, tabs 48 of each pool fall into place just inboard of the inner surface of the wire retaining rim 46 of the spool below. Further, the bottom surface of the wear plate 40 of each spool 36 rests directly on the top surface of hub 38 of the spool below (again except for the wear plate 40 of the lowermost spool 36, which rests directly on disc 32).

The arrangement of the stacked spools 36 is best shown in FIG. 2 wherein the bottom four spools are shown loaded with wire coils 64. From that Figure, the purpose of intermeshed tabs 48 now becomes apparent: There is a slight gap between the top edge of wire retaining rim 46 of a spool 36 and the bottom surfaces of the spokes 42 of the spool above; if the wire strand on the lower spool 36 should work its way between its wire retaining rim 46 and the one directly above it, the wire could be drawn onto hub 38 of its own spool and becomed fouled during rotation of that spool. The presence of tabs 48 projecting from the spool above prevents the wire strand from penetrating to hub 38; thus, the wire strand is effectively confined to its own wire retaining rim 46.

After the ten spools 36 are in place on shaft 34, cap ring 50 is lowered onto shaft 34. Bracket assembly 52, which has been pivoted away from shaft 34 to permit spool loading, then is swung downwardly in its pivotal mounting to permit collar 56 to slide over the top of shaft 34 as best shown in FIG. 1. Bolt 62 may be adjusted as necessary to accomplish the sliding engagement of collar 56 with shaft 34. Dispenser 10 is now in condition to be hooked to its towing means which, in the embodiment shown in the drawings, is a standard farm tractor 66.

The attachment of tractor 66 to dispenser 10 is made by way of a conventional three point hitch towing assembly 68 to three hitch points on dispenser 10. Those hitch points are best shown in FIG. 1 as a pair of lugs 70 extending from upstanding frame members 16, together with a pair of holes 72 formed in spaced vertical plates 74 which span transverse members 22 and 24. The details of towing assembly 68 and its manner of connection with the hitch points just described are well known in the art.

Figure 5:
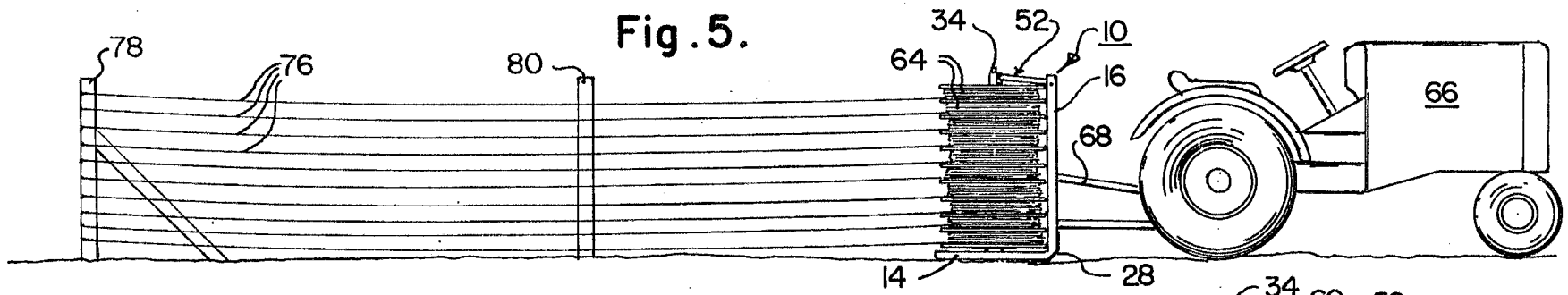
FIG. 5 is a diagrammatic view of the present invention in use.

Dispenser 10 is towed into position adjacent the starting fence post 78 (see FIG. 5) of a proposed fence line. The posts for this fence line have been previously installed. The ends of the wire strands 76 from coils 64 are stapled to the starting fence post 78 in the desired spaced relationship. Thereafter, tractor 66 is slowly accelerated to tow dispenser 10 along the line of proposed fence posts 80, etc. As dispenser 10 is dragged along the ground on its skids, spools 36 are free to rotate on shaft 34 and thus pay out the wire coiled thereon. As shown in FIG. 5, the individual wire strands 76 are vertically seperated as they are unreeled from dispenser 10 and, although the strands eventually may sag to their ground of their own weight, the orderly unreeling process prevents them from becoming fouled.

As dispenser 10 is towed, shaft 34 tends to deflect rearwardly because of the tensile forces applied by wire strands 76. As shaft 34 deflects, a downward compression force is applied by bracket assembly 52 to spools 36 thus urging them to retain their original positions with respect to shaft 34. This compressive force is made possible by the upward inclination of bracket assembly 52 referred to above. Accordingly, collar 56 need not be rigidly secured to shaft 34.

On flat terrain, dispenser 10 will be stopped at the approximate midpoint of the fence line to permit the stapling of the strands 76 to a fence post in that location. Such intermediate stapling will be performed more frequently on hilly terrain, especially at the high and low terrain points. When dispenser 10 reaches the final fence post in the proposed fence line, the wire strands 76 are cut and their ends stapled to the final post. Generally, the installer then returns to the intermediate fence posts to which the dispensed wire has been secured and, using well-known stretching techniques and equipment, draws each strand taut to the desired degree and completes the stapling of the taut strands to the remaining fence posts in the line.

Use of dispenser 10 in the manner just described permits the installer to make only one pass along the proposed fence line to dispense wire. The resultant economies in time and labor over conventional fence installation methods are self evident.

It will be appreciated by those skilled in the art that dispenser 10 could be modified to adapt it to a wheeled carrier; this modification might be useful in areas of uniformly flat terrain where extremely long sections of fencing are required such as in the Southwest. Likewise, it will be appreciated that spools 36 could be fitted with braking devices to apply a drag force to each wire strand as it is payed out.

If a dispenser 10 of the present invention having ten spools is to be used to install, say, a five strand fence, all tens spools may be fitted on shaft 34 with only five spools having been loaded with coils 64. Alternatively, by forming additional holes in upstanding frame members 16, the pivotal mounting of bracket assembly 52 may be adjusted downwardly so that only five spools loaded with coils 64 need to be fitted on shaft 34. This alternative preserves the upward angular relationship of bracket assembly 52 with respect to the stack of spools and the resultant benefit of that feature as discussed above.

What is claimed is:

1. Mobile apparatus for dispensing fencing wire comprising:

a frame;

means associated with said frame for facilitating its transport;

a single upstanding shaft mounted on said frame;

a plurality of rotatable spools, each having a strand of wire coiled thereon, supported for rotation on said shaft and adapted to simultaneously unreel said wire strands; and wire guide means associated with each of said spools and spaced radially outward therefrom for maintaining said wire strands in vertically spaced relationship as they are unreeled.

2. Mobile apparatus as recited in claim 1 which further comprises:

means disposed at the top of said shaft for retaining said spools in their respective positions on said shaft during the transport of said frame.

3. Mobile apparatus as recited in claim 2 wherein:

said spool retaining means includes a bracket pivotally mounted to said frame and arranged to apply a downward force on said spools when said shaft is deflected away from said pivotal mounting.

4. Mobile apparatus for dispensing fencing wire comprising:

a frame;

means associated with said frame to facilitate its transport;

an upstanding shaft disposed within said frame;

a plurality of spools rotatably mounted on said shaft in a vertically stacked relationship, each spool including a central hub, support members radially extending from said hub, a wire retaining rim connected to said support members, and a wire guide ring connected to said support members outboard of said wire retaining rim, and each spool above the lowermost spool having tab means extending downwardly from its support members to project inside the wire retaining rim of the spool below;

a continuous strand of fencing wire coiled on each of said spools; and spool retaining means disposed at the top of said shaft.

5. Mobile apparatus as recited in claim 4 wherein:

said spool retaining means includes a ring member mounted on said shaft above the uppermost of said spools, and a bracket member pivotally mounted to said frame and extending into sliding engagement with the top of said shaft.

6. Mobile apparatus for dispensing fencing wire comprising:

a frame;

an upstanding shaft mounted on said frame;

a plurality of spools rotatably mounted on said shaft, each spool adapted to accept a coil of fencing wire thereon;

wire guide means associated with each of said spools, said wire guide means including vertically spaced ring members; and means disposed at the top of said shaft for retaining said spools on said shaft.

* * * * *